US005153658A

United States Patent [19]

Lundy et al.

[11] Patent Number: 5,153,658

[45] Date of Patent: Oct. 6, 1992

[54] MAC CLEANER BRUSH FILM CONTROL

[75] Inventors: Douglas A. Lundy, Webster; Kip L. Jugle, Rochester; Daniel W. MacDonald, Ontario Farmington; Robin E. Berman; Carl B. Hurwitch, both of Rochester, all of N.Y.

[73] Assignee: Xerox Corporation, Stamford, Conn.

[21] Appl. No.: 742,997

[22] Filed: Aug. 9, 1991

[51] Int. Cl.[5] ..... G03G 21/00

[52] U.S. Cl. ..... 355/301; 15/1.51; 15/256.5; 355/208; 355/296; 355/326

[58] Field of Search ..... 355/203, 204, 206, 208, 355/246, 296, 301, 306, 326; 15/1.51, 256.5, 256.51, 256.52

[56] References Cited

U.S. PATENT DOCUMENTS 3,815,988 6/1974 McVeigh et al. ..... 355/75
4,361,922 12/1982 Karal ..... 355/303 X
4,435,073 3/1984 Miller ..... 355/305
4,673,284 6/1987 Matsumoto et al. ..... 15/256.51 X
4,894,685 1/1990 Shoji ..... 355/204 X
4,945,388 7/1990 Tange et al. ..... 355/296
4,999,673 3/1991 Bares ..... 355/208

*Primary Examiner*—A. T. Grimley
*Assistant Examiner*—J. E. Barlow, Jr.

[57] ABSTRACT

A process for controlling the amount of film buildup on a photoreceptor surface caused by certain print mode and/or material throughput conditions in a single pass highlight color printer which enables or promotes photoreceptor filming by the DAD toner additive (i.e. zinc stearate). Such filming results in the tri-level Image Push defect. This process utilizes toner coated cleaner brushes to control the film buildup thus preventing the defect. This process defines a functional equation that maintains a toner concentration at the cleaner brush fiber tips thereby controlling photoreceptor filming.

21 Claims, 4 Drawing Sheets

MAC CLEANER BRUSH FILM CONTROL

BACKGROUND OF THE INVENTION

This invention relates generally to a color electrostatographic printing machine, and more particularly, cleaning brushes to remove toner additive film particle buildup on the photoconductive member.

In a colored image forming apparatus, an electrostatic latent image which is to be developed by a predetermined color is formed on a photoconductor by an optical system of a copying machine or printer. Then, the electrostatic latent image is developed by a developing unit which accommodates a predetermined colored toner to be used for development. This toner image may be subsequently transferred to a support surface such as copy paper to which it may be permanently affixed by heating or by the application of pressure. After each transfer process, the toner remaining on the photoconductor is cleaned by a cleaning device.

However, when colored toners other than black toner are cleaned from the photoreceptor, there is a tendency for more residual toner to remain on the photoconductor. Thus, the photoreceptor is not able to be efficiently cleaned by the same process that is used to clean black toner alone from the photoreceptor. Possible reasons for the additional filming on the photoconductor caused by the color toners are the dye, pigment or additive used in the color toners. For example, zinc stearate (ZnSt) and Aerosil are essential additives to the color toners to enhance toner flow and stabilize developer conductivity. During the printing process the ZnSt is preferentially developed in the background regions of the photoreceptor, not transferred to the print paper, and subsequently smeared on the photoreceptor by the cleaner brushes. As the ZnSt film thickens with time, Aerosil particles become embedded in the film, causing a secondary print quality defect referred to as deletions, Charge Area Development (CAD) loss, or lateral charge conductivity. It is an objective of this invention to prevent smearing of the additive on the photoreceptor, remove additive film from the surface of the photoconductive member and to prevent the print quality defects caused by the embedded particles.

Certain print mode and/or material mass per unit time throughput (i.e., where throughput is greater than 5% color area coverage) conditions in a single pass highlight color printer enable or promote photoreceptor filming by the Discharge Area Development (DAD) toner additive zinc stearate (ZnSt). Such film is the origin of the tri-level Image Push defect: Image Push defect is: the movement of the color toner during the black development cycle due to the loss of the coefficient of friction on the P/R surface by the formation of the slippery ZnSt; or the sliding of the color image on the photoreceptor as it passes by the black developer housing due to the loss of coefficient of fiction on the photoreceptors by the slippery ZnSt.

Various ideas as to how to improve cleaning efficiency have been disclosed. One publication suggested mixing toner with a small amount of low adhesive polymeric additive in smaller average particle size than that of the toner of each developer. Another publication discloses each developer being mixed with an abrasive for removing matter adhered to the photoconductor when the cleaning process is conducted. Yet another publication discloses an idea for removing a matter adhered to the photoconductor with a resin by providing a grinding device aside from a cleaning device.

However, in the colored image forming apparatus, it is a laborious task to mix the proper amount of suitable polymeric additive or abrasive with each developer and it can become expensive. Moreover, it is not preferable for use in forming a colored image which requires a delicate tone since it badly affects the clearness of color and permeability when the additive or abrasive are mixed with a colored toner other than black toner.

Various cleaning techniques have hereinbefore been used as illustrated by the following disclosure, which may be relevant to certain aspects of the present invention: U.S. Pat. No. 4,945,388 to Tange et al. describes a method and apparatus for cleaning a color image from a photoreceptor wherein a black toner only image is transferred onto the photoreceptor periodically when the color developing units are actuated, without any transfer process, to remove residual black toner. A black toner only image is fixed to the photoreceptor during machine startup and after a certain number of copies.

Co-pending application, Ser. No. 07/569,798 to Frankel et al., filed AUG. 20, 1990, describes an imaging device with a brush cleaner loaded with one type of toner to abrade the photoreceptor to remove the second type of toner.

SUMMARY OF INVENTION

In accordance with one aspect of the present invention, there is provided a method of replenishing particles in a cleaner brush adapted to contact a photoreceptor used in a printing machine of the type having successive images developed thereon that includes the following steps. Developing a line pattern recorded on the photoreceptor in a non-image region. Removing the particles from the photoreceptor with the cleaning brush so that particles adhere to the brush preventing smearing on the photoreceptor and abrading the film from the photoreceptor.

Pursuant to another aspect of the present invention, there is provided a cleaner brush film control apparatus for replenishing particles in a cleaner brush adapted to contact a photoreceptor used in a printing machine of the type having successive images developed thereon. This apparatus includes a means for developing a line pattern recorded on the photoreceptor in a non-image region. Means for removing the particles from the photoreceptor with the cleaning brush so that particles adhere to the brush preventing smearing of the photoreceptor and abrading the film from the photoreceptor.

BRIEF DESCRIPTION OF THE DRAWINGS

Other objects and advantages of the present invention will become apparent upon reading the following detailed description and upon reference to the drawings, in which.

(A) is a schematic of a brush fiber contacting a toner additive particle.

Figure 4:
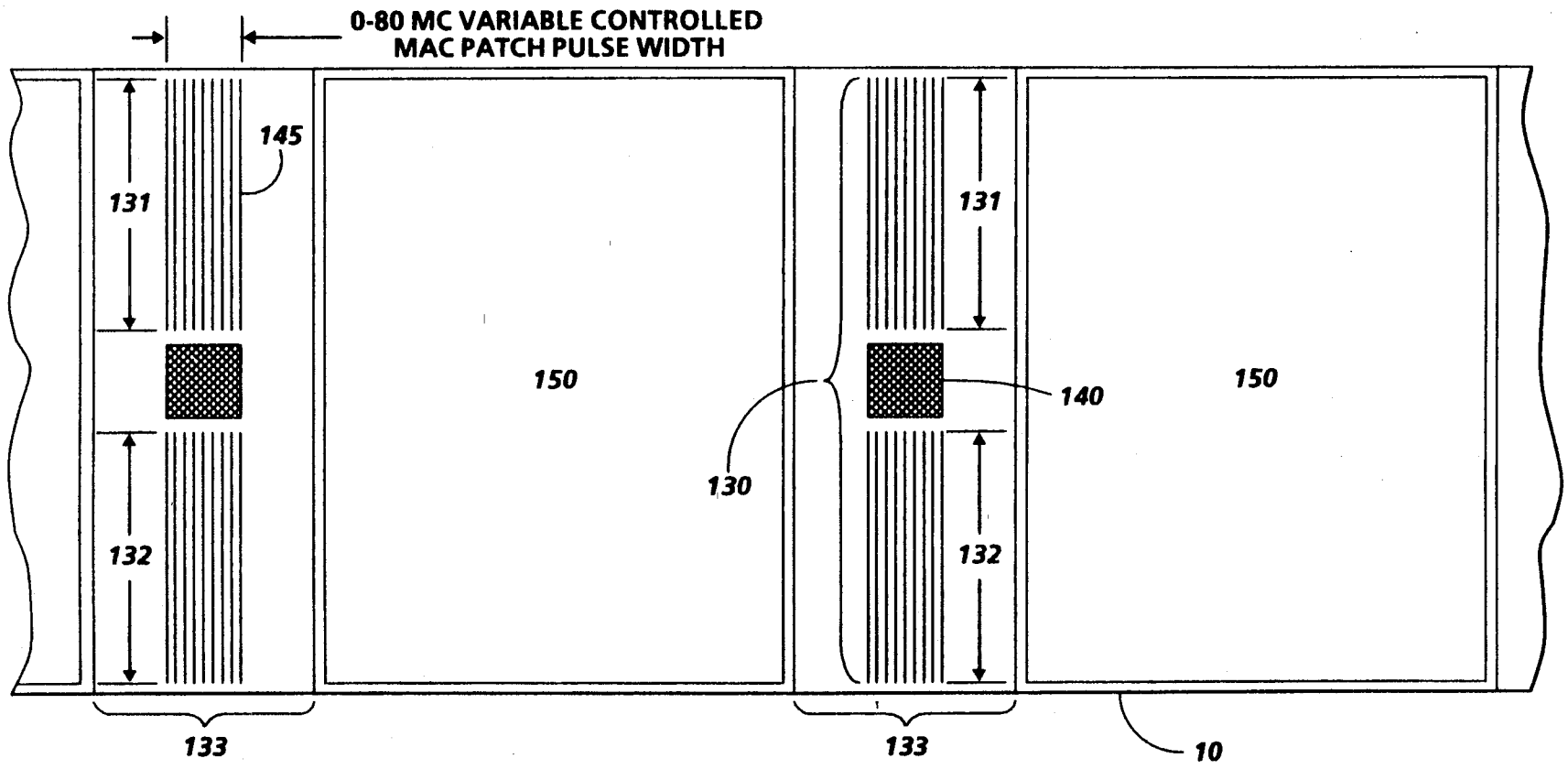

(B) is a schematic of black toner attached to the fiber tips of the brush;

(C) is a schematic of black toner and aerosil attached to the fiber tips of the brush as the brush fiber contacts a toner additive particle; and FIG. 4 shows a schematic of minimum area coverage on a photoreceptor.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
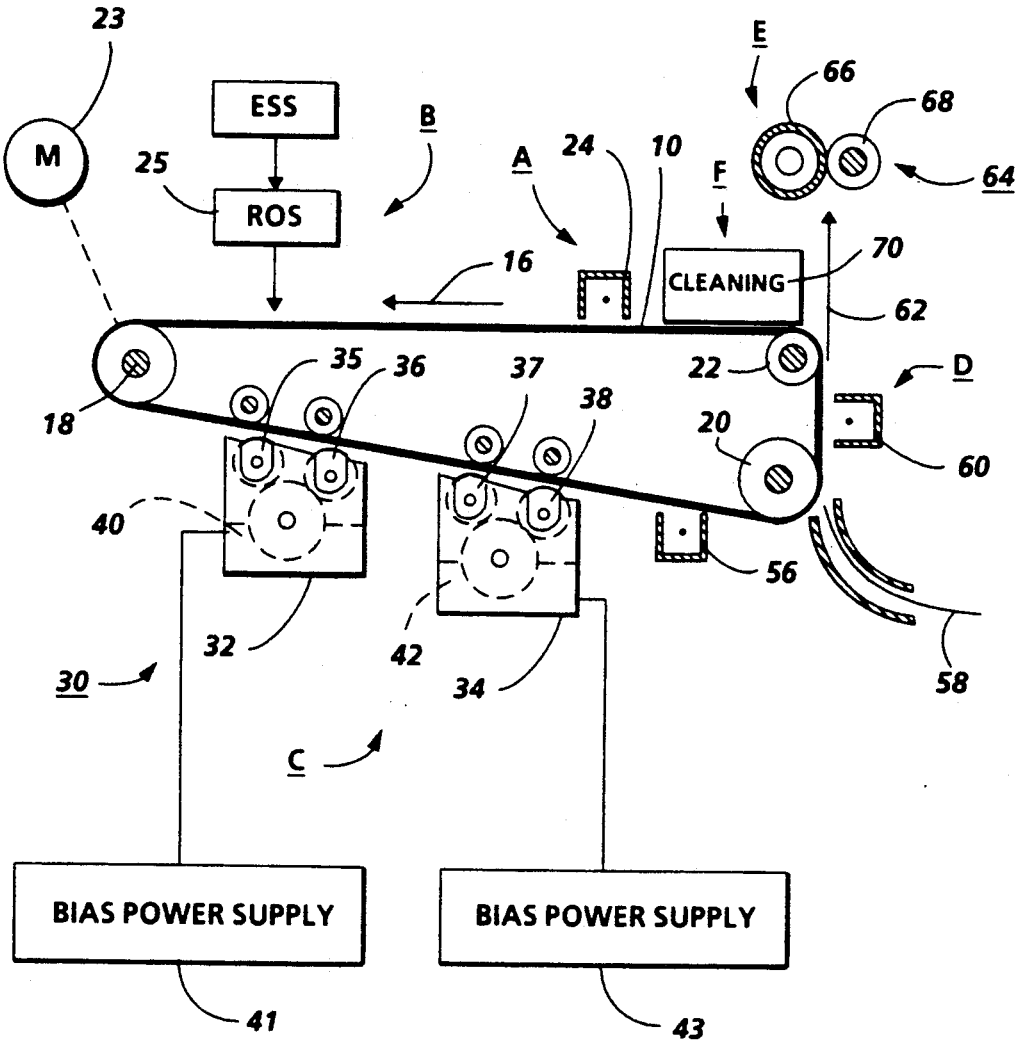
FIG. 1 is a schematic illustration of a printing apparatus incorporating the inventive features of the invention.

For a general understanding of an electrostatographic printing machine in which the present invention may be incorporated, reference is made to FIG. 1 which depicts schematically the various components thereof. Hereinafter, like reference numerals will be employed throughout to designate identical elements. Although the cleaning apparatus of the present invention is particularly well adapted for use in an electrostatographic printing machine, it should become evident from the following discussion, that it is equally well suited for use in a wide variety of devices and is not necessarily limited to the particular embodiments shown herein.

Referring now to the drawings, where the showings are for the purpose of describing a preferred embodiment of the invention and not for limiting same, the various processing stations employed in the reproduction machine illustrated in FIG. 1 will be briefly described. p A reproduction machine in which the present invention finds advantageous use utilizes a charge retentive member in the form of a photoconductive belt 10 consisting of a photoconductive surface and an electrically conductive, light transmissive substrate and mounted for movement past a charging station A, an exposure station B, developer stations C, transfer station D, and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numberal 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas. [The high voltage latent image is developed with positive (+) charged black toner and is called Charge Area Development (CAD). The low voltage latent image is developed with negative (−) charge color toner and Discharge Area Development (DAD)].

The photoreceptor, which is initially charged to a voltage undergoes dark decay to a lower voltage level. When exposed at the exposure station B it is discharged to near zero or ground potential in the highlight (i.e. color other than black) color parts of the image. The photoreceptor is also partially discharged in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer staton D from a supply tray, not shown. Sheets are fed from the tray with sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying.

Residual toner and debris remaining on photoreceptor belt 10 after each copy is made, may be removed at cleaning station F with a brush cleaning system 70.

Figure 2:
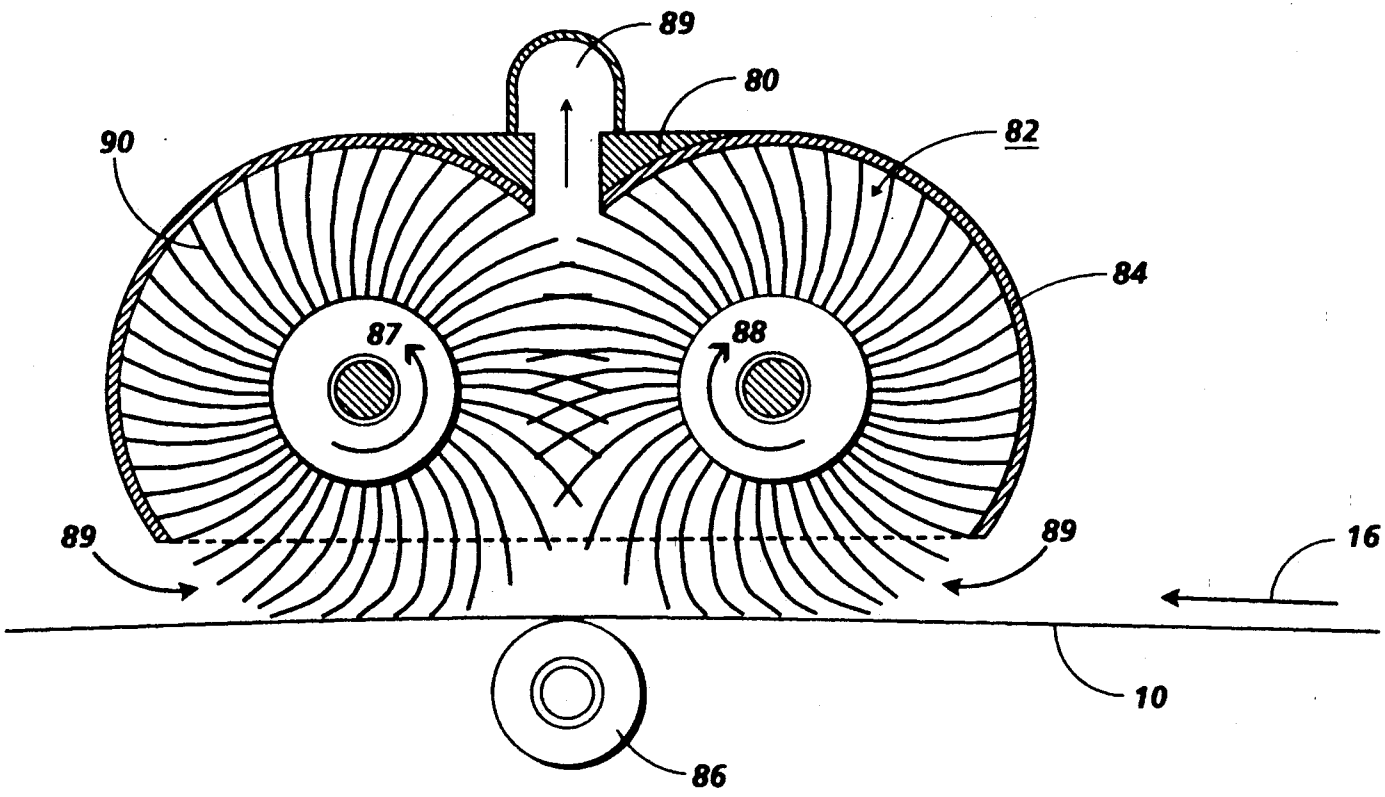
FIG. 2 is a schematic of a dual insulated cleaning brush system with flicker bars.

Referring now to FIG. 2 which shows a cleaning brush system. The insulated fiber brushes 82 used for cleaning (e.g. cleaner brushes) are located in a cleaner housing 84. The fibers 90 rotate against the photoreceptor 10 surface supported by a cleaning roll 86. The dual insulated fiber brushes 82 rotate in opposite directions 87, 88. When these insulated fiber brushes 82 rub against the charging bars (or flicker bars) 80, the triboelectric charge produced will attract and hold one of the toners, either positive (+) or negative (−) depending on the selection of the charging bar and fiber. In the case of the present invention's system the mono filament brush fiber 90 rubbing against charging bars 80 (e.g. polytetrafluoroethylene materials such as Teflon produce a high negative (−) field thus attracting and holding the positive (+) black toner. By using the selected fiber brush material (e.g. modactylic such as kanecaron) and flicker bars (or charging bars) (e.g. material is a polytetrafluoroethylene), 80 the positive black toner is held to the brush fiber tip. An air vacuum 89 is used to remove debris from the brush fibers 90.

Alternatively, a different fiber to bar combination that produces a high positive (+) charge would attract and hold the color negative (−) type toners. The specific print mode in which the Image Push defect is initiated is during color executive mode when only color toner is being used, and the additive (ZnSt) is being preferentially developed.

Figure 3A:
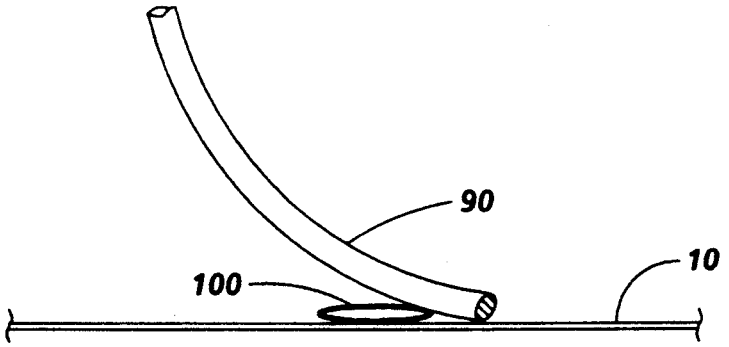
FIG. 3.
Figure 3B:
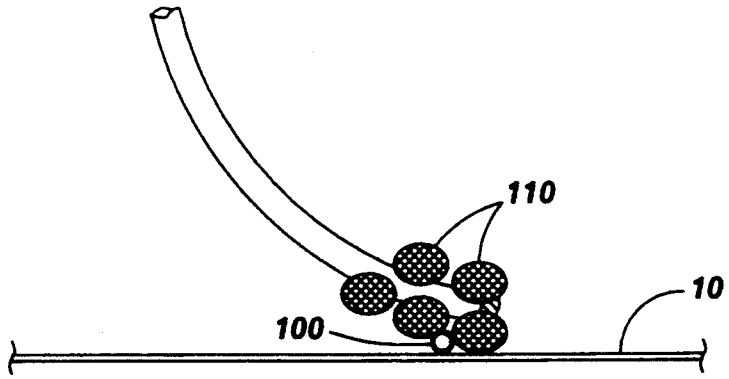
Figure 3C:
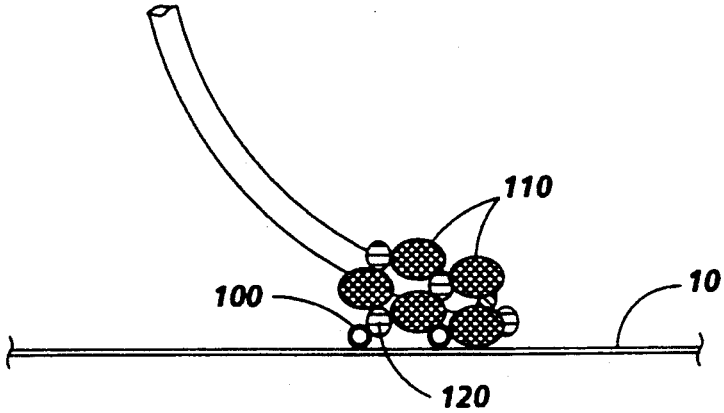

Referring now to FIGS. 3(A), 3(B), and 3(C). FIG. 3 (A) shows what occurs in the typical mode of cleaning the photoreceptor. The brush fiber 90 as it rotates against the photoreceptor 10 contacting the surface has a tendency to smear the additive particles 100 (e.g. ZnSt). The smearing results from the force of the brush fibers 90 rotational motion as they land on the additive particles. The present invention of adding positively charged toner to the fiber tips of the cleaning brushes 82 (see FIG. 2) to avoid additive smearing and to control additive film buildup can perform in one of the following ways shown in FIGS. 3(B) or 3(C). In FIG. 3(B), it is shown how the black toner (positive) 110 attaches to the fiber 90 tip to provide a sort of buffer between the individual fibers 90 and the photoreceptor 10 surface thereby, preventing the brush fibers from smearing the additive particles 100 as the fibers 90 rotate. FIG. 3(C) shows the attachment of black toner (positive) 110 and Aerosil particles 120 to the brush fibers 90. The Aerosil particles 120 abrade the additive particles 100 (e.g. ZnSt) film from the photoreceptor 10 surface.

Referring now to the specific subject matter of the present invention, FIG. 4 shows the minimum area coverage (MAC) patch 130 used to apply toner to the cleaner brush fibers. The MAC patch consists of zip tone lines 145 of toner in the interdocument area 133 (e.g. non-image area) and a control patch 140 of the photoreceptor 10. The brush fibers contact this area and in so doing, black toner is applied to the brush fiber tips. This process is called Minimum Area Coverage or MAC patch. This approach provides a continuous supply of black toner often but in small samples hence, the renewable source of positive toner to the cleaner brushes is provided. The control of this continuous (e.g. renewable) supply of toner is handled by an algorithm which will be described below. The disadvantage of the MAC patch is that this run mode requires highlight rather than color executive run mode. Highlight is defined as single-pass two color printing, single pass development of color and black toner or a process in which both color and black images area layed down on the photoreceptor at the same time enabling single mass development of the color and black images. This MAC process is reversible to accommodate negative (−) toner.

A color image toner film cleaner requires a minimum throughput of black toner in order to maintain control of color toner filming on the photoreceptor. Since the tri-level mode may result in long runs of high color toner throughput with minimum black throughput, we need an artifical method of supplying black toner to the cleaner brushes.

The artifical increase in material mass throughput is, in effect, wasting very expensive material which the customer must pay for. Therefore, the materials and process design must make every effort to minimize the use of the minimum area coverage (MAC) patch. This will impact the minimum area coverage algorithms in the following ways: minimum area slope will be in NVM (non volatile memory) to allow fine tuning as program materials and database mature and, compensation will be based on accumulated history for discrete blocks which allows long term averaging. In order to maintain efficient cleaning of aerosil and zinc stearate from the photoreceptor, the cleaner brushes must be coated with black (or color depending on the system) toner.

Referring again to FIG. 4, since the MAC patch will present high mass untransferred image to the cleaner, it will be very stressful on the cleaning system. Therefore, the present invention allows two cleaning passes for all images (i.e. the minimum area coverage patch will be printed on only two walking interdocument zones per cycle).

The ROS (raster output scanner) requirements for the MAC patch are defined as follows. The ROS shall be capable of writing two MAC patches in the interdocument zone, one to the inboard side 131 of the interdocument process control patch 140, the other to the outboard side 132. See FIG. 4. These patches 131, 132 are fixed in both location and length. The first 131 starts at internal pixel count 481 and ends at pixel count 2113. The second 132 begins at pixel count 2681 and ends at pixel count 4397. The width, slow scan direction is variable and definable in software with an acceptable range of machine clocks (MC). Each of the two patch areas will consist of alternating lines of black and color pixels. The line width shall be approximately eight (8) pixels. There shall be separate controls for black and color. If black is disabled the line shall be printed as white. The value of the ROS exposure shall be applied to the MAC patch. The MAC patch supplies the equivalency of 11% MAC Area Coverage. ROS exposure for the given mode shall apply to the MAC patch. It is noted that full patches, when active would provide approximately 2.5% maximum area coverage.

The pixel board shall receive a digital signal the period of which defines an envelope proportional to the area coverage desired in the MAC patch area 130. Increments shall be in MC steps with a patch size of 0.0 mm width, patch disabled, to a maximum width equal to the normal interdocument process control patch 140. The control patch 140 determines the image printed in the image area 150. The scan length of each MAC patch 131, 132 shall be approximately 156 mm. The location of the MAC interdocument patches shall not interfere with the variable interdocument control patch 140 location.

The total feed forward pixel count will be accumulated for a period of time corresponding to 50 pitches of black developer housing on time. Individual counts will be kept for the color and black housings.

A requirement for greater than 80 machine clocks of MAC patch will result in a truncated response as described below. Pixel counting will be done in sets of 2**18 pixels. Response will be 0–80 machine clocks of on time. ROS will provide 8 pixel black and white) alternating lines during "on time".

The MAC patch will not be required during start up, system shut down period of time when machine (printer) is still running but is not making prints and it is preparing to stop, or during any diagnostic routine. The appropriate MAC patch will be required during running of black executive mode. By definition of the algorithm, extended running in the black executive mode will result in no black MAC patch. In the event of a power down, the number of black housings on pitches, current MAC required clock count, and current total number of feed forward pitches must be retained in NVM.

Arithmetically 1232/5=246.4 mm/pitch; 833/246.4=3.38 machine clocks/mm.; $(8.4\times10^4\times50)/2^{**}18=16$ pixel "sets"/50 prints @ 1% a.c. (ref 8.5×11). The functional slope will be NVM continuously variable from 0 to 0.3 with a precision of 0.01.

The required algorithm is as follows: accumulate the total number of feed forward pixel sets for black and color (2**18 pixels) for 50 pitches of black housing on time (pixel counts must be accumulated during cycle up, cycle down, total xerographic convergence (TXC) and toner concentration (TC) adjust routines. The functional equation is:

$$(Ncp-1.4N_{bp})\times K_1=N_{mc}$$

where:

$N_{cp}$=number of color pixel sets (2**18 pixels);

$N_{bp}$=number of color pixel sets (2**18 pixels);

$K_1$=constants (i.e. is a constant that indicates the relationship between the pixel count and the number of machine clocks of MAC patch that are laid down.

$N_{mc}$=number of machine clocks of MAC patch required.

If the net total pixel count is <0 no MAC patch will be written. If $K_1$ times the net total is >80 then 80 machine clocks of MAC patch will be written. Obviously rounding will be applied as required. Patches will not be written during cycle up or cycle down. Patches will be written and counted during run time electrostatic and TC adjust routines.

While the present invention was described in terms of the black (i.e. positive) toner to attract negatively charged film particles, the method described herein is reversible for negative (−) toners.

In recapitulation, the present invention is a process for providing a renewable source of toner to the cleaner brushes thus controlling additive buildup. It is evident that the addition of toner to the cleaner brushes will remove the additive buildup common in color toner. It is also evident that the charge on the brushes can be switched to allow effective cleaning of oppositely charged filming on the photoreceptor surface. The MAC patch process is a preferred method of cleaner brush film control because it utilizes a small quantity of toner and doesn't require the printing machine to be shut down in order to perform this cleaning process.

It is, therefore, apparent that there has been provided in accordance with the present invention, a process for providing a renewable source of toner to the cleaner brushes thus controlling additive buildup that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method of replenishing particles of a first polarity in a cleaner brush adapted to contact a photoreceptor used in a printing of the type having successive images developed thereon with at least one of the images being developed with particles of a second polarity opposite in polarity to the first polarity, comprising the steps of:

developing a line pattern recorded on the photoreceptor in a non-image region with the first polarity particles;

removing the first polarity particles from the photoreceptor with the cleaning brush so that first polarity particles adhere to the brush; and removing the second polarity particles adhering to the photoreceptor with the cleaning brush having the first polarity particles adhering thereto preventing smearing of the photoreceptor, and abrading film therefrom.

2. The method of claim 1, wherein the particles of the first polarity are black toner particles.

3. The method of claim 2, wherein a quantity of black toner developed in the non-image region is a function of the quantity of black toner particles and non-black toner particles developed in the image.

4. The method of claim 3, wherein the black toner particles are positively charged.

5. The method of claim 4, wherein a plurality of line patterns are recorded on the photoreceptor with each line being recorded in a different non-image region.

6. The method of claim 1, wherein the particles of the first polarity are non-black toner particles.

7. The method of claim 6, wherein a quantity of non-black toner developed in the non-image region is a function of the quantity of black toner particles and non-black toner particles developed in the image.

8. The method of claim 7, wherein the non-black toner particles are negatively charged.

9. The method of claim 8, wherein a plurality of line patterns are recorded on the photoreceptor with each line being recorded in a different non-image region

10. A cleaner brush film control apparatus for replenishing particles of a first polarity in a cleaner brush adapted to contact a photoreceptor used in a printing machine having successive images thereon with at least one of the images being developed with particles of a second polarity opposite in polarity to the first polarity, comprising:

means for recording at least a line pattern on the photoreceptor in a non-image region thereon;

means for developing the line pattern recorded on the photoreceptor in the non-image region with the first polarity particles; and means for removing the first polarity particles from the photoreceptor so that the first polarity particles adhere thereto and, subsequently, said removing means having the first polarity particles adhering thereto, removing the second polarity particles from the photoreceptor, preventing smearing of the photoreceptor, and abrading film therefrom.

11. A cleaner brush film control apparatus for replenishing black toner particles of a first polarity in a cleaner brush adapted to contact a photoreceptor used in a printing machine having successive images thereon with at least one of the images being developed with particles of a second polarity opposite in polarity to the first polarity, comprising:

means for recording at least a line pattern on the photoreceptor in a non-image region, wherein a quantity of black toner developed in the non-image region is a function of the quantity of black toner particles and non-black toner particles developed in the image;

means for developing the line pattern recorded on the photoreceptor in the non-image region with the first polarity particles; and means for removing the first polarity particles from the photoreceptor so that the first polarity particles adhere thereto and, subsequently, said removing means having the first polarity particles adhering thereto, removing the second polarity particles from the photoreceptor, preventing smearing of the photoreceptor, and abrading film therefrom.

12. An apparatus as recited in claim 11, wherein the black toner particles are positively charged.

13. An apparatus as recited in claim 12, wherein a plurality of line patterns are recorded on the photoreceptor with each line being recorded in a different non-image region.

14. An apparatus recited in claim 10, further comprising:

a flicker bar; and at least one insulated brush adapted to rotate so that a plurality of brush fibers contact said flicker bar appropriately charging the brush fibers causing oppositely charged toner to be attracted and attached thereto as the brush fibers contact the photoreceptor surface containing the charged toner in the non-image region.

15. An apparatus as recited in claim 14, wherein said brush fibers material is modacrylic.

16. An apparatus as recited in claim 14, wherein said flicker bar material is polytetrafluoroethylene.

17. An apparatus as recited in claim 14, wherein said brush fibers containing the black positive toner particles of the first polarity rotate against said photoreceptor surface prevents smearing of the photoreceptor surface and causes abrading of a toner additive film from said photoreceptor surface.

18. An apparatus as recited in claim 14, wherein said brush fibers containing the non-black negative toner particles of the first polarity, by rotating against said photoreceptor surface prevents smearing of said photoreceptor surface and causes abrading of a toner additive from said photoreceptor surface.

19. A cleaner brush film control apparatus for replenishing non-black toner particles of a first polarity in a cleaner brush adapted to contact a photoreceptor used in a printing machine having successive images thereon with at least one of the images being developed with particles of a second polarity opposite in polarity to the first polarity, comprising:

means for recording at least a line pattern on the photoreceptor in a non-image region, wherein a quantity of non-black toner developed in the non-image region is a function of the quantity of black toner particles and non-black toner particles developed in the image;

means for developing the line pattern recorded on the photoreceptor in the non-image region with the first polarity particles; and means for removing the first polarity particles from the photoreceptor so that the first polarity particles adhere thereto and, subsequently, said removing means having the first polarity particles adhering thereto, removing the second polarity particles from the photoreceptor, preventing smearing of the photoreceptor, and abrading film therefrom.

20. An apparatus as recited in claim 19, wherein the non-black toner particles are negatively charged.

21. An apparatus of claim 20, wherein a plurality of line patterns are recorded on the photoreceptor with each line being recorded in a different non-image region.

* * * * *